US006284723B1

(12) United States Patent
Zhou et al.

(10) Patent No.: US 6,284,723 B1
(45) **Date of Patent: *Sep. 4, 2001**

(54) ANTIMICROBIAL HARD SURFACE CLEANER

(76) Inventors: Boli Zhou, 3005 Terrance View Ave., Antioch, CA (US) 94509; Anna G. Stanislowski, 20 Woodland Dr., Alamo, CA (US) 94507; Wayne B. Scott, 2168 Youngs Ct., Walnut Creek, CA (US) 94596

( * ) Notice: Subject to any disclaimer, the term of this patent is extended or adjusted under 35 U.S.C. 154(b) by 0 days.

This patent is subject to a terminal disclaimer.

(21) Appl. No.: 09/480,310

(22) Filed: Jan. 10, 2000

Related U.S. Application Data

(63) Continuation of application No. 08/807,187, filed on Feb. 27, 1997, now Pat. No. 6,013,615, and a continuation of application No. 08/507,543, filed on Jul. 26, 1995, now abandoned.

(51) Int. Cl.[7] ..... C11D 1/835
(52) U.S. Cl. ..... 510/384; 510/503; 510/504
(58) Field of Search ..... 510/238, 362, 510/421, 422, 423, 434, 480, 490, 503, 504, 384

(56) References Cited

U.S. PATENT DOCUMENTS

| | | | | |
|---|---|---|---|---|
| 3,812,046 | | 5/1974 | Lancz | 252/106 |
| 3,965,026 | | 6/1976 | Lancz | 252/106 |
| 4,058,489 | * | 11/1977 | Hellsten | 252/547 |
| 4,065,409 | | 12/1977 | Flanagan | 252/528 |
| 4,174,304 | | 11/1979 | Flanagan | 252/524 |
| 4,203,872 | | 5/1980 | Flanagan | 252/524 |
| 4,264,479 | | 4/1981 | Flanagan | 252/524 |
| 4,272,395 | | 6/1981 | Wright | 252/106 |
| 4,284,435 | | 8/1981 | Fox | 134/2 |
| 4,336,151 | | 6/1982 | Like et al. | 252/106 |
| 4,443,363 | | 4/1984 | Klinger et al. | 252/547 |
| 4,455,250 | | 6/1984 | Frazier | 252/106 |
| 4,464,293 | | 8/1984 | Dobrin | 252/547 |
| 4,537,802 | | 8/1985 | Flanagan | 427/368 |
| 4,540,505 | | 9/1985 | Frazier | 252/106 |
| 4,576,729 | | 3/1986 | Paszek et al. | 252/106 |
| 4,597,887 | | 7/1986 | Colodney | 252/106 |
| 4,690,779 | | 9/1987 | Baker et al. | 252/546 |
| 4,804,492 | | 2/1989 | Bernarducci | 252/106 |

(List continued on next page.)

FOREIGN PATENT DOCUMENTS

| | | | |
|---|---|---|---|
| 715521 | 8/1965 | (CA) . | |
| 0651 048 | 5/1995 | (EP) | C11D/1/835 |
| 2693738 | 1/1994 | (FR) . | |
| 2075043 | 11/1981 | (GB) | C11D/1/835 |
| 264097 | 9/1994 | (JP) . | |

OTHER PUBLICATIONS

Vol. 1: Emulsifiers & Detergents, McCutcheon's 1995, pp. 5, 87, 185 and 320 [Received by PTO Library May 12, 1995].

European Search Report for Appn. 95.304637.2.

*Primary Examiner*—John Hardee
(74) *Attorney, Agent, or Firm*—Joel J. Hayashida

(57) ABSTRACT

The invention provides an aqueous, antimicrobial, no-rinse hard surface cleaner with significantly improved residue removal and substantially reduced filming/streaking, said cleaner comprising:

(a) an effective amount of a solvent selected from $C_{1-6}$ alkanol, $C_{3-24}$ alkylene glycol ether, and mixtures thereof;

(b) an effective amount of a surfactant selected from amphoteric, nonionic surfactants, and mixtures thereof, (c) an effective amount of a quaternary ammonium surfactant;

(d) an effective amount of a builder; and (e) the remainder as substantially all water.

8 Claims, 1 Drawing Sheet

U.S. PATENT DOCUMENTS

| | | | |
|---|---|---|---|
| 4,978,685 | 12/1990 | Gannon et al. | 514/642 |
| 5,061,395 | 10/1991 | Meng | 252/173 |
| 5,196,135 | 3/1993 | Merianos et al. | 252/106 |
| 5,252,245 | 10/1993 | Garabedian, Jr. et al. | 252/153 |
| 5,252,257 | 10/1993 | Hoffmann et al. | 252/547 |
| 5,308,401 | 5/1994 | Geke et al. | 134/2 |
| 5,330,674 | 7/1994 | Urfer et al. | 252/176.17 |
| 5,389,685 | 2/1995 | Smith et al. | 514/643 |
| 5,454,984 | 10/1995 | Graubart et al. | 252/547 |
| 6,013,615 * | 1/2000 | Zhou et al. | 510/434 |

* cited by examiner

ANTIMICROBIAL HARD SURFACE CLEANER

This is a continuation of application Ser. No. 08/807,187, filed Feb. 27, 1997 now U.S. Pat. No. 6,013,615, itself a continuation of Ser. No. 08/507,543, filed Jul. 26, 1995, now abandoned, entitled "ANTIMICROBIAL HARD SURFACE CLEANER"

BACKGROUND OF THE INVENTION

1. Field of the Invention

The invention relates to a non-rinse, isotropic, antimicrobial hard surface cleaner especially adapted to be used on glossy or smooth, hard surfaces, which removes soils deposited thereon and disinfects same, while significantly reducing the amount of residue caused by unremoved soil, cleaner, or a combination thereof.

2. Brief Statement of the Related Art

Cleaning hard, glossy surfaces has proven to be problematic. To remove soils deposited on such surfaces, the typical approach is to use an alkaline ammonium-based aqueous cleaner or other aqueous cleaners containing various mixtures of surfactants and other cleaning additives. Unfortunately, many of the ammonia-based cleaners have fairly poor soil removing ability, while many of the surfactant-based cleaners leave fairly significant amounts of residue on such hard, glossy surfaces. This residue is seen in the phenomena of streaking, in which the soil, cleaner, or both are inconsistently wicked off the surface, and filming, in which a thin layer of the residue actually clings to the surface desired to be cleaned.

Additionally, quaternary ammonium based liquid hard surface cleaners are in common use, typically as bathroom cleaners. Certain quaternary ammonium compounds can be effective as antimicrobial agents in small dosages in these cleaners. However, these types of cleaners typically are not effective on glossy, hard surfaces because they tend to leave a visible residue.

Baker et al., U.S. Pat. No. 4,690,779, demonstrated a hard surface cleaner having improved non-streaking/filming properties in which a combination of low molecular weight polymer (e.g., polyethylene glycol) and certain surfactants were combined.

Corn et al., E.P. 0393772 and E.P. 0428816, describe hard surface cleaners containing anionic surfactants with ammonium counterions, and additional adjuncts.

G.B. 2,160,887 describes a cleaning system in which a combination of nonionic and anionic surfactants (including an alkanolamine salt alkyl sulfate) is contended to enhance cleaning efficacy.

WO 91/11505 describes a glass cleaner containing a zwitterionic surfactant, monoethanolamine and/or beta-aminoalkanols as solvents/buffers for assertedly improving cleaning and reducing filming spotting.

Garabedian et al., U.S. Pat. No. 5,252,245, and its related applications, U.S. patent application Ser. Nos. 08/134,349 and 08/134,348, both filed Oct. 8, 1993, and Choy et al., U.S. patent application Ser. No. 08/410,470, all of common assignment herewith, disclose improved glass and surface cleaners which combine either amphoteric or nonionic surfactants with solvents and effective buffers to provide excellent streaking/filming characteristics on glass and other smooth, glossy surfaces. These disclosures are incorporated herein by reference thereto. None of these related glass and surface cleaners contain bactericides, such as quaternary ammonium compounds.

A series of patents to Flanagan (U.S. Pat. No. 4,065,409, U.S. Pat. No. 4,174,304, U.S. Pat. No. 4,203,872 and U.S. Pat. No. 4,264,304) describe dilutable cleaner concentrates which included quaternary ammonium surfactants. The compositions of these inventions do not claim or show improved filming/streaking properties.

Thus, the prior art no-rinse hard surface cleaners fail to achieve the desired goals of reduced residue (streaking and/or filming) and antimicrobial action.

SUMMARY OF THE INVENTION AND OBJECTS

The invention provides an aqueous, antimicrobial no-rinse hard surface cleaner with significantly improved residue removal and substantially reduced filming/streaking, said cleaner comprising:

(a) an effective amount of a solvent selected from $C_{1-6}$ alkanol, $C_{3-24}$ alkylene glycol ether, and mixtures thereof;

(b) an effective amount of a surfactant selected from amphoteric, nonionic surfactants, and mixtures thereof;

(c) an effective amount of a quaternary ammonium surfactant;

(d) an effective amount of a builder; and (e) the remainder as substantially all water.

The invention further comprises a method of cleaning soils from hard surfaces by applying said inventive cleaner to said soil, and removing both from said surface, while disinfecting said surface.

It is therefore an object of this invention to improve soil removal from hard surfaces.

It is another object of this invention to disinfect hard surfaces while improving soil removal performance.

It is another object of this invention to reduce filming which results from a residue of cleaner, soil, or both remaining on the hard surface intended to be cleaned, without the need for rinsing of said surface.

It is a further object of this invention to reduce streaking, which results from inconsistent removal of the cleaner, soil, or both, from the hard surface intended to be cleaned, without the need for rinsing of said surface.

DETAILED DESCRIPTION OF THE INVENTION

Figure 1:
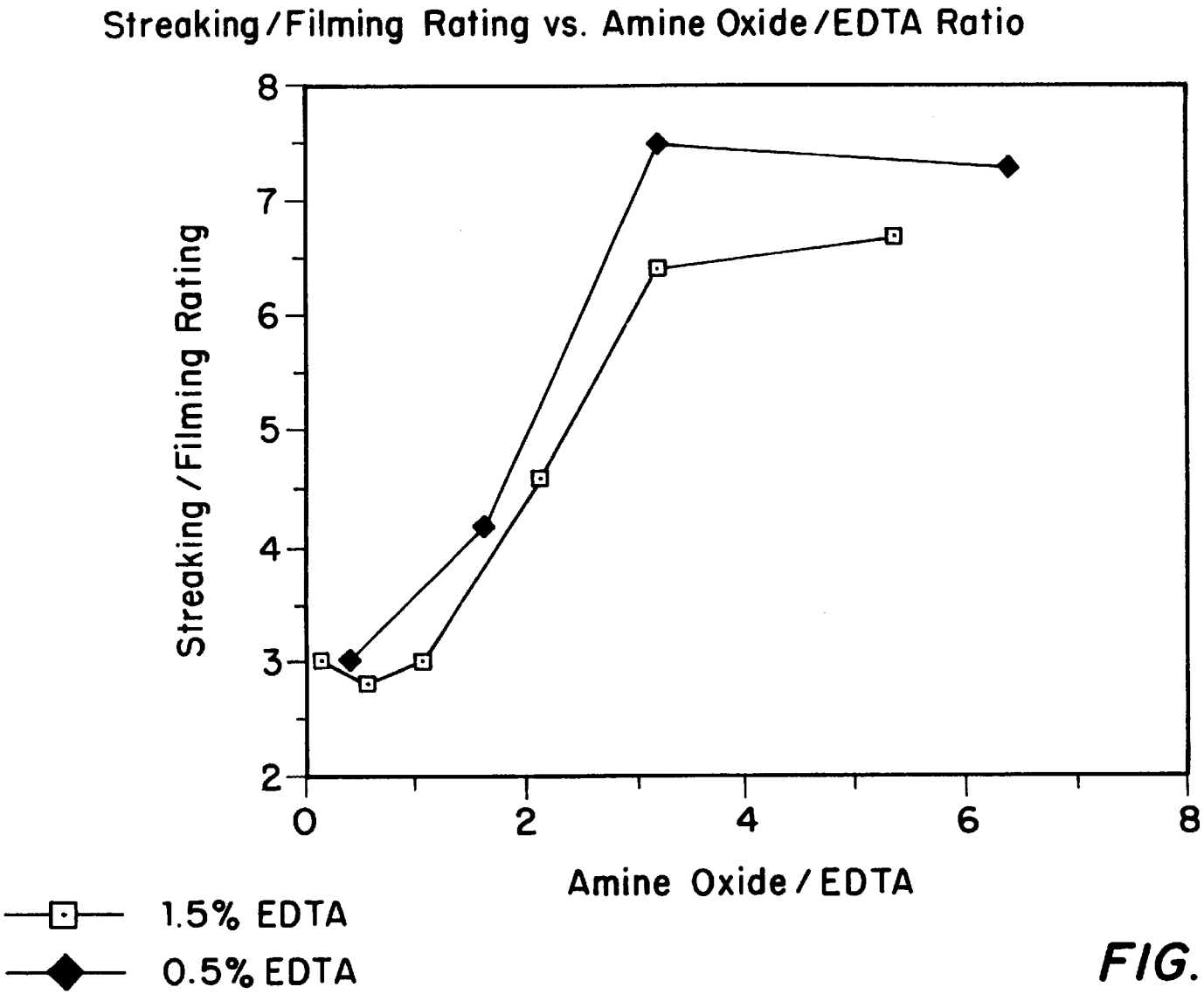
FIG. 1 is a graphical depiction of the performance of the inventive cleaner.

The invention is an improved cleaning, substantially non-streaking/filming, antimicrobial no-rinse hard surface cleaner especially adapted to be used on glossy or smooth, hard surfaces. The category of cleaner to which the invention belongs is the no-rinse, all purpose hard surface disinfectant cleaner. These types of cleaners are intended to clean hard surfaces by application of a metered discrete amount of the cleaner, typically by pump or trigger sprayer onto the surface to be cleaned or onto the workpiece, such as a soft cloth or sponge, and then wiping the surface, thus removing the soil and the cleaner, without the need for rinsing with water. The inventive cleaner now benefits from the presence of a quaternary ammonium surfactant which contributes to antimicrobial efficacy, while the cleaner itself unexpectedly leaves minimal or no residue on the surface being cleaned. The cleaner itself has the following ingredients:

(a) an effective amount of a solvent selected from $C_{1-6}$ alkanol, $C_{3-24}$ alkylene glycol ether, and mixtures thereof;

(b) an effective amount of a surfactant selected from amphoteric, nonionic surfactants, and mixtures thereof, (c) an effective amount of a quaternary ammonium surfactant; and (d) an effective amount of a builder; and (e) the remainder as substantially all water.

Additional adjuncts in small amounts such as fragrance, dye and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent of the composition.

1. Solvents

The solvent is selected from $C_{1-6}$ alkanol, $C_{3-24}$ alkylene glycol ether, and mixtures thereof. The alkanol can be selected from methanol, ethanol, n-propanol, isopropanol, butanol, pentanol, hexanol, their various positional isomers, and mixtures of the foregoing. In the invention, it has been found most preferable to use isopropanol, usually in conjunction with a glycol ether. It may also be possible to utilize in addition to, or in place of, said alkanols, the diols such as methylene, ethylene, propylene and butylene glycols, and mixtures thereof.

It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, dipropylene glycol methyl ether, and mixtures thereof. Two preferred glycol ethers are ethylene glycol, monobutyl ether, also known as butoxyethanol, sold as butyl Cellosolve by Union Carbide, and also sold by Dow Chemical Co., and propylene glycol n-propyl ether, available from a variety of sources. Another preferred alkylene glycol ether is propylene glycol, t-butyl ether, which is commrercially sold as Arcosolve PTB, by Arco Chemical Co. It has the structure:

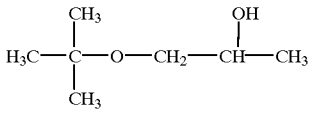

Other suppliers of preferred solvents include Union Carbide. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%.

2. Surfactants

The surfactant is selected from nonionic and amphoteric surfactants, and mixtures thereof.

The nonionic surfactants are selected from alkoxylated alcohols, alkoxylated ether phenols, and other surfactants often referred to as semi-polar nonionics, such as the trialkyl amine oxides. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. The semi-polar amine oxides are especially preferred, although, for the invention, a mixture of nonionic and amine oxide surfactants are most preferred. These have the general configuration:

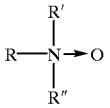

wherein R is $C_{6-24}$ alkyl, and R' and R" are both $C_{1-4}$ alkyl, or $C_{1-4}$ hydroxyalkyl, although R' and R" do not have to be equal. These amine oxides can also be ethoxylated or propoxylated. The preferred amine oxide is lauryl amine oxide, such as Barlox 12, from Lonza Chemical Company.

It has been surprisingly found that—when amine oxides are used as the surfactant, and EDTA is used as the builder, and quaternary ammonium compounds are used as the antimicrobial agent in this invention—to obtain effective streaking/filming performance, the ratio of amine oxide:EDTA must be carefully controlled in the invention. The amount of amine oxide must exceed the amount of EDTA, and exceeds about 2:1 and most preferably must exceed about 3:1.

At this time, it is appropriate to discuss the accompanying graph of FIG. 1. The axis of the graph is the streaking/filming performance of the inventive cleaner with the test conducted by visual grading on a 1 to 10 scale (higher results being better). The x axis is the ratio (on a 100% actives basis) of amine oxide:EDTA. Two different EDTA solutions were used, one with 1.5% actives, the other, with 0.5% actives. Consistently, and surprisingly, those formulations achieving at least a 2:1 or greater ratio of amine oxide:EDTA outperformed lower ratios of amine oxide:EDTA.

A further preferred semi-polar nonionic surfactant is alkylamidoalkylenedialkylamine oxide. Its structure is shown below:

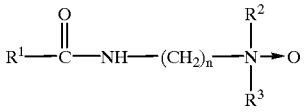

wherein $R^1$ is $C_{5-20}$ alkyl, $R^2$ and $R^3$ are $C_{1-4}$ alkyl, $R^1$—C—NH—$(CH_2)_n$— or —$(CH_2)_p$—OH, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole).

This surfactant is available from various sources, including from Lonza Chemical Company, as a cocoamidopropyldimethyl amine oxide, sold under the brand name Barlox C.

The amphoteric surfactant is typically an alkylbetaine or a sulfobetaine. Especially preferred are alkylamidoalkyldialkylbetaines. These have the structure:

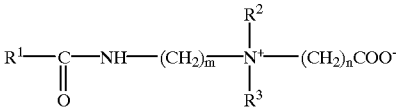

wherein $R^1$ is $C_{6-20}$ alkyl, $R^2$ and $R^3$ are both $C_{1-4}$ alkyl, although $R^2$ and $R^3$ do not have to be equal, and m can be 1–5, preferably 3, and n can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Sherex Chemical Co., which offers Varion CADG, both of which products are cocobetaines.

The amounts of surfactants present are to be somewhat minimized, for purposes of cost-savings and to generally restrict the dissolved actives which could contribute to leaving behind residues when the cleaner is applied to a surface. However, the amounts added are generally about 0.001–5%, more preferably 0.002–2.00% surfactant.

3. Quaternary Ammonium Surfactant

The invention further requires a cationic surfactant, specifically, a quaternary ammonium surfactant. These types of surfactants are typically used in bathroom cleaners because they are generally considered "broad spectrum" antimicrobial compounds, having efficacy against both gram positive (e.g., Staphylococcus sp.) and gram negative (e.g., *Escherischia coli*) microorganisms. However, it has been previously found that hard surface cleaners containing quaternary ammonium compounds typically leave residue and thus perform relatively poorly on glossy hard surfaces. For example, it has been noted that:

> ". . . positively charged cationic surfactants are more strongly adsorbed than anionic or nonionic surfactants on a variety of substrates including textiles, metal, glass, plastics, minerals, and animal and human tissue, all of which can often carry a negative surface charge." (Kirk-Othmer, *Encyclopedia of Chemical Technology* 3d, Vol. 22, p. 378 (1983).

The foregoing passage thus reflects the widely held view that cationic surfactants, such as quaternary ammonium compounds, are strongly contraindicated for use in hard surface cleaners because their presence will naturally tend to leave residues on hard surfaces thus cleaned. And, it has been observed that streaking/filming performance, as can be expected, is uniformly poor when such quaternary ammonium compounds are formulated into no-rinse hard surface cleaners. However, because of the unique formulations of the invention in which the ratio of amine oxide to EDTA is carefully controlled, the inventive compositions have surprisingly superior streaking/filming performance compared to other quaternary ammonium-based cleaning formulations.

Applicants further believe without limitation to any particular theory, that anionic counterions play a very important role in the adsorption of cationic surfactants to surfaces. Cationic surfactants apparently form ion pairs with anionic counterions, thus increasing the surface activity of such cationic surfactants. Polyvalent anions such as EDTA can therefore increase the adsorption of cationic surfactants through the mechanism of ion pairing (*Cationic Surfactants, Physical Chemistry*, in: Surfactant Science Series Vol. 37, p. 93 (Marcel Dekker, 1983). Accordingly, it is believed, without limitation, that amine oxide plays a special role in limiting or mitigating the ion-pairing affinity of EDTA for quaternary ainmonium compounds.

4. Builder

The builder comprises (a) a chelating builder, which is an alkali metal ethylene diamine tetraacetate (EDTA), most preferably tetrasodium salt, and, optionally, but preferably also, (b) a buffering builder selected from the group consisting of: ammonium, alkali metal and alkaline earth metal hydroxides, alkali metal carbonates, alkali metal silicates, and mixtures thereof Of these in (b), the alkali metal hydroxides appear preferable, especially sodium hydroxide.

The chelating builder comprises an important aspect of the invention. As mentioned above, there appears to be an interaction between the amine oxide surfactant and the builder, particularly EDTA.

The amount of builder added should be in the range of 0.01–2%, more preferably 0.01–1%, by weight of the cleaner, while hydroxide, if present, should be added in the range of 0.001–1% by weight ofthe cleaner.

5. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is most preferred.

Small amounts of adjuncts can be added for improving cleaning performance or aesthetic qualities of the cleaner. Adjuncts for cleaning include additional surfactants, such as those described in Kirk-Othmer, *Encyclopedia of Chemical Technology*, 3rd Ed., Volume 22, pp. 332–432 (Marcel-Dekker, 1983), which are incorporated herein by reference. Aesthetic adjuncts include fiagrances, such as those available from Givaudan, IFF, Quest and others, and dyes and pigments which can be solubilized or suspended in the formulation, such as diarninoanthraquinones. The amounts of these cleaning and aesthetic adjuncts should be in the range of 0–2%, more preferably 0–1%.

In the following Experimental section, the surprising performance benefits of the various aspects of the inventive cleaner are demonstrated.

EXPERIMENTAL

Two formulations, the first being inventive, the second being a comparative example, are set forth below as Examples 1–2.

Example 1

| Ingredient | Wt. % | % Actives |
|---|---|---|
| Quaternary ammonium surfactant[1] | 0.6 | 0.3 |
| NaOH | 0.2 | 0.2 |
| Nonionic surfactant[2] | 0.25 | 0.25 |
| Amine oxide surfactant[3] | 2.2 | 0.66 |
| Solvent[4] | 2.0 | 2.0 |
| $Na_4EDTA$[5] | 0.56 | 0.21 |
| D.I. $H_2O$ | Q.S.[6] | |

[1]Barquat MB-50, $C_{14}$ alkylbenzyldimethylammonium chloride (50% solution). In all of the following examples, if the same ingredient is listed and identified, the identification and percent active (e.g., % solution) provided hereunder will be relied upon.
[2]Alfonic 610-50, $C_{6-10}$ ethoxylated alcohol, about 3 moles of ethylene oxide per mole of alcohol (50% solution)
[3]Barlox 12, $C_{12}$ alkyl dimethylamine oxide, from Lonza Inc., (30% solution)
[4]Ethylene glycol, monobutyl ether
[5]Builder, sodium ethylenediaminetetraacetate, 38% solution
[6]quantity sufficient to make up 100% formulation
In the above Inventive Example 1, the ratio of amine oxide: EDTA is 3.15:1.

COMPARATIVE EXAMPLE 2

| Comparative Example 2 | | |
|---|---|---|
| Ingredient | Wt. % | % Active |
| Quaternary ammonium surfactant | 0.6 | 0.3 |
| NaOH | 0.2 | 0.2 |
| Nonionic surfactant | 0.25 | 0.25 |
| Amine oxide surfactant | 0.25 | 0.075 |
| Solvent | 2.0 | 2.0 |
| $Na_4EDTA$ | 3.9 | 1.4 |
| D.I. $H_2O$ | Q.S. | |

[1]Unless further identified, all of the ingredients are the same as the prior Example.

In the above Comparative Example 2, the amine oxide:EDTA ratio is about 1:18.6.

The two formulations 1 and 2 were compared against one another and against a number of commercially available cleaners for filming/streaking performance on glass mirror tiles. Three of these commercial cleaners contained a quaternary ammonium compound as a biocide. A grading scale of 1 to 10 was used, with 1 being worst and 10 being best. The results are tabulated below:

TABLE I

| Filming/Streaking Performance | | | | |
|---|---|---|---|---|
| Example/Product | 1 | 2 | Lysol[1] | Formula 409 ®[2] |
| S/F Performance | 7.7 | 2.3 | 3.9 | 8.3 |
| Example/Product | Formula 409 ®[3] GSC | Commercial[4] Product 1 | Commercial[5] Product 2 | Commercial[6] Product 3 |
| S/F Performance | 9.4 | 2.1 | 2 | 3.1 |

[1]L&F Products, Antibacterial Kitchen Cleaner, hard surface cleaner, which contains 0.1% quaternary ammonium compound.
[2]The Clorox Company, hard surface cleaner, which does not contain quaternary ammonium compound.
[3]The Clorox Company, glass and surface cleaner, which does not contain quaternary ammonium compound.
[4]Antimicrobial cleaner which contains 0.3% quaternary ammonium compound.
[5]Antimicrobial cleaner which contains 0.2% quaternary ammonium compound.
[6]Antimicrobial cleaner which contains 0.2% quaternary ammonium compound.

As can be seen from the foregoing data, Example 1, which had the preferred >3:1 ratio of amine oxide: EDTA, clearly outperformed Example 2, which has a ratio of 1:18.6, as well as the commercial product Lysol Antibacterial Kitchen Cleaner, and as well as commercial products 1–3, all of which are bactericidal products. Additionally, its streaking/filming performance was comparable to that of Formula 409® all purpose cleaner and Formula 409® Glass and Surface Cleaner, both of which are hard surface cleaners without bactericides.

| Ingredient | Example 3 | Example 4 | Example 5 |
|---|---|---|---|
| NaOH | 0.2% | 0.2% | 0.2% |
| Quat.[1] | 0.6% | 0.6% | 0.6% |
| Nonionic[2] | 0.25% | 0.25% | 0.25% |
| Solvent[3] | 2.0% | 2.0% | 2.0% |
| EDTA | 0.5% | 1.5% | 0.5% |
| Amine Ox.[4] | 2.0% | 6.0% | 4.0% |
| D.I. $H_2O$ | Q.S. | Q.S. | Q.S. |

-continued

| AO/EDTA[7] | 3.15:1 | 3.15:1 | 6.3:1 | |
|---|---|---|---|---|
| Ingredient | Example 6 | Example 7 | Example 8 | Example 9 |
| NaOH | 0.2% | 0.2% | 0.2% | 0.2% |
| Quat.[1] | 0.6% | 0.6% | 0.6% | 0.4% |
| Nonionic[6] | 0.25% | 0.36% | 0.36% | 0.36% |
| Solvent[3] | 2.0% | 3.0% | 2.0% | 3.0% |
| EDTA | 0.5% | 0.5% | 0.5% | 0.5% |
| Amine Ox.[4] | 2.0% | 2.0% | 2.0% | 2.0% |
| D.I. $H_2O$ | Q.S. | Q.S. | Q.S. | Q.S. |
| AO/EDTA[7] | 3.15:1 | 3.15:1 | 3.15:1 | 3.15:1 |

[1]Quaternary ammonium compound, Barquat MB-50
[2]Nonionic surfactant, Surfonic N-100, ethoxylated $C_9$alkylphenol, 10 moles of ethylene oxide, from Texaco Chemical.
[3]Ethylene glycol, monobutyl ether.
[4]C12 alkyl dimethylamine oxide (30%).
[5]Quantity sufficient to make up 100% solution.
[6]Nonionic surfactant, Alfonic 610-50.
[7]Ratio of amine oxide:EDTA (100% actives basis)

TABLE II

| Filming/Streaking Performance | | | |
|---|---|---|---|
| Example | 3 | 4 | 5 |
| S/F Performance | 7.5 | 6.7 | 7.3 |
| Example | 6 | 7 | |
| S/F Performance | 7.9 | 7.7 | |

As can be seen from the above Table II, Inventive Examples 3–7, streaking/filming performance was excellent for these formulations. Examples 8–9, although ungraded by test panelists, were comparable to 3–7 by visual observation.

Further, in Table III below, the antimicrobial properties of certain of the inventive formulations were demonstrated. In these examples, ASTM Standard Test Method E1135-87 (1987), "Efficacy of Sanitizers Recommended for Inanimate Non-Food Contact Surfaces," (incorporated herein by reference thereto), was modified for use with the inventive formulations as the sanitizer solutions. As can be seen from the collected data, the inventive formulations possess excellent antimicrobial efficacy. Although not all formulations were tested, they would be expected to have similar efficacies.

TABLE III

Antimicrobial Efficacy after 1 Minute Contact with Formulations

| Bacterium | Example | 1 | 5 | 6 |
|---|---|---|---|---|
| *Staph. aureus* | % reduction | ≧99.99% | ≧99.99% | (not conducted) |
| *Enterobacter aerogenes* | % reduction | ≧99.99% | (not conducted) | ≧99.99% |

| | Example | 7 | 9 |
|---|---|---|---|
| *Staph. aureus* | % reduction | ≧99.99% | ≧99.99% |
| *Klebsiella pneumoniae* | % reduction | ≧99.99% | ≧99.99% |

What is claimed is:

1. An aqueous, antimicrobial hard surface cleaner with significantly improved residue removal and substantially reduced filming/streaking, said cleaner comprising:

(a) about 1–50% of a solvent selected from $C_{1-6}$ alkanol, $C_{3-24}$ alkylene glycol ether, and mixture thereof;

(b) about 0.001–5% of amine oxide surfactant;

(c) an antimicrobially effective amount of a quaternary ammonium surfactant;

(d) 0.01–2% of alkali metal ethylenediaminetetraacetate builder; and (e) the remainder as substantially all water, the ratio of b:d ranging from about 2:1 to about 6.3:1.

2. The hard surface cleaner of claim 1 wherein said solvent is an alkylene glycol ether which is selected from the group consisting of ethylene glycol monobutyl ether, ethylene glycol monopropyl ether, propylene glycol monopropyl ether, propylene glycol monobutyl ether, and mixtures thereof.

3. The hard surface cleaner of claim 2 wherein said solvent is ethylene glycol monobutyl ether.

4. The hard surface cleaner of claim 1 further comprising a nonionic surfactant other than the amine oxide.

5. The hard surface cleaner of claim 4 wherein said nonionic surfactant is an ethoxylated alcohol.

6. The hard surface cleaner of claim 1 further comprising a buffer selected from the group consisting of ammonium, alkali metal and alkaline earth metal hydroxides, alkali metal carbonates, alkali metal silicates, and mixtures thereof.

7. The hard surface cleaner of claim 6 wherein the buffer is alkali metal hydroxide.

8. A method of cleaning soil, without substantial residue remaining, from a hard surface comprising applying the cleaner of claim 1 to said soil and removing said soil and said cleaner.

* * * * *